US010689078B2

(12) United States Patent
Desch et al.

(10) Patent No.: US 10,689,078 B2
(45) Date of Patent: Jun. 23, 2020

(54) WATERJET PROPULSION SYSTEM AND WATERCRAFT HAVING A WATERJET PROPULSION SYSTEM

(71) Applicant: Andreas Desch, Zell an der Pram (AT)

(72) Inventors: Andreas Desch, Zell an der Pram (AT); Hubert Baumgartner, Lockenhaus (AT); Johann Waldherr, Gols (AT)

(73) Assignee: ANDREAS DESCH, Zell an der Pram (AT)

( * ) Notice: Subject to any disclaimer, the term of this patent is extended or adjusted under 35 U.S.C. 154(b) by 157 days.

(21) Appl. No.: 15/577,187

(22) PCT Filed: May 27, 2016

(86) PCT No.: PCT/AT2016/000058
§ 371 (c)(1),
(2) Date: Nov. 27, 2017

(87) PCT Pub. No.: WO2016/187627
PCT Pub. Date: Dec. 1, 2016

(65) Prior Publication Data

US 2018/0170500 A1 Jun. 21, 2018

(30) Foreign Application Priority Data

May 27, 2015 (AT) ..... A 333/2015

(51) Int. Cl.
*B63H 11/08* (2006.01)
*B63H 11/103* (2006.01)
*B63H 21/17* (2006.01)

(52) U.S. Cl.
CPC ..... *B63H 11/08* (2013.01); *B63H 11/103* (2013.01); *B63B 2751/00* (2013.01); *B63H 21/17* (2013.01)

(58) Field of Classification Search
CPC ..... B63H 11/08; B63H 11/103; B63H 21/17
See application file for complete search history.

(56) References Cited

U.S. PATENT DOCUMENTS 5,462,460 A 10/1995 Kobaysahi
2006/0057907 A1* 3/2006 Fuse ..... B63H 11/08 440/38

(Continued)

FOREIGN PATENT DOCUMENTS

CN 87101817 A 10/1987
CN 1032526 A 4/1989

(Continued)

OTHER PUBLICATIONS

International Search Report dated Sep. 8, 2016 by the European Patent Office in International Application PCT/AT2016/000058.

(Continued)

*Primary Examiner* — S. Joseph Morano
*Assistant Examiner* — Jovon E Hayes
(74) *Attorney, Agent, or Firm* — Henry M. Feiereisen LLC

(57) ABSTRACT

The invention relates to a waterjet propulsion system (1) for a watercraft, comprising an intake region (2), an impeller region (3) which adjoins the intake region and in which a one-stage impeller (4) is mounted, and an outlet nozzle (5) which adjoins the impeller region, the waterjet propulsion system having a drive motor (6) which is at least indirectly connected to an impeller driveshaft (7) of the impeller (4). According to the invention, the impeller has only one single blade (8).

23 Claims, 3 Drawing Sheets

(56) References Cited

U.S. PATENT DOCUMENTS

| | | | | |
|---|---|---|---|---|
| 2012/0231681 | A1* | 9/2012 | Shibayama | B63H 25/46 440/3 |
| 2013/0137317 | A1* | 5/2013 | Shibayama | B63H 11/04 440/6 |
| 2018/0170500 | A1* | 6/2018 | Desch | B63H 11/08 |

FOREIGN PATENT DOCUMENTS

| | | | | |
|---|---|---|---|---|
| CN | 2702913 | Y | | 6/2005 |
| CN | 1652971 | A | | 8/2005 |
| CN | 203222104 | U | | 10/2013 |
| CN | 204078047 | U | | 1/2015 |
| JP | 2002-308183 | | | 10/2002 |
| JP | 2002308183 | A | * | 10/2002 |
| JP | 2002-362488 | | | 12/2002 |
| JP | 2002362488 | A | * | 12/2002 |
| WO | WO 2005/115832 | | | 12/2005 |
| WO | WO 2011/042515 | | | 4/2011 |

OTHER PUBLICATIONS

Chinese Search Report dated Jan. 28, 2019 with respect to counterpart Chinese patent application 201680038075.6.
Translation of Chinese Search Report dated Jan. 28, 2019 with respect to counterpart Chinese patent application 201680038075.6.

* cited by examiner

WATERJET PROPULSION SYSTEM AND WATERCRAFT HAVING A WATERJET PROPULSION SYSTEM

CROSS-REFERENCES TO RELATED APPLICATIONS

This application is the U.S. National Stage of International Application No. PCT/AT2016/000058, filed May 27, 2016, which designated the United States and has been published as International Publication No. WO 2016/187627 and which claims the priority of Austrian Patent Application, Serial No. A 333/2015, filed May 27, 2015, pursuant to 35 U.S.C. 119(a)-(d).

BACKGROUND OF THE INVENTION

The invention relates to a waterjet propulsion system.

Waterjet propulsion systems are known which have an intake region, a compressor part and a drive nozzle. The compressor part in this case has a plurality of blades, which are driven by a drive shaft. The drive shaft is passed through the intake region or the drive nozzle.

Such known waterjet propulsion systems have the disadvantage that due to the guidance of the drive shaft a sealed shaft bushing is required. Such a shaft bushing is technically complex and maintenance-intensive. This causes high acquisition and maintenance costs. Such a shaft bushing also has a high friction, thus necessitating high drive power. Furthermore, this drive shaft directly crosses a flow area and causes turbulence either in front of the impeller or in the outlet nozzle, further reducing the efficiency of such drives and, in turn, increasing the required drive power. In addition, this can lead to cavitation on the drive shaft. Furthermore, the drive shaft transmits rotational energy to the surrounding water, which leads to a deterioration of the flow conditions in the intake or nozzle area, and leads to a further braking of the drive shaft and an increase in the required drive power.

Known waterjet propulsion systems also have a high tendency to clog due to objects that are sucked in, which is why the operation in heavily polluted and/or fish-rich waters or in the immediate vicinity of the ground is often not possible. Even a floating bag in the water, a diaper or a large fish can damage the drive and therefore lead to operational interruption. The grids on the intake openings, which are often required in the case of known drives, further increase the flow resistance and lead to turbulent swirls in the intake region, as a result of which the required drive power is further increased.

Due to the different causes mentioned, high drive powers and correspondingly strong drive mechanisms are required in the case of the customary waterjet propulsion systems. Several hundred kW of drive power are quite common in so-called personal watercrafts, which are also abbreviated PWC, thus requiring the acquisition of a special driving authorization. Such drives are formed as an internal combustion engine due to the high power required, usually designed as a gasoline engine, and cause high noise and pollutant emissions. The operation of such powered vehicles is therefore prohibited in many waters.

The noise development of such drives or the thus operated boats also limits the use of the same for leisure activities, and prevents use in the field of nature observation or in the field of military intelligence.

SUMMARY OF THE INVENTION

It is therefore the object of the invention to provide a waterjet propulsion system of the type mentioned, in which the mentioned disadvantages can be avoided, which only requires a low drive power, and which can be operated without problems in waters which are interspersed with objects to a large extent.

In accordance with the invention, this is achieved by a waterjet propulsion system for a watercraft, having an intake region, an impeller region adjoining the intake region, in which a single-stage impeller is arranged, and one outlet nozzle at least indirectly adjoining the impeller region, wherein the waterjet propulsion system has a drive motor which is connected at least indirectly to an impeller drive shaft of the impeller, wherein the impeller has only one single blade.

The subject waterjet propulsion system has a simple and above all compact design. The waterjet propulsion system has a hydrodynamically clean structure, whereby the required drive power is low.

As a result, a waterjet propulsion system can be created which only requires a low drive power. Due to the low required drive power, operation is also possible with an electric motor, wherein the waterjet propulsion system can still provide sufficient thrust in order to operate a watercraft in an agile manner. By operation with an electric motor, and thus further associated low noise, such a powered watercraft can be operated virtually without restrictions on all waters, including environmental protection areas. Due to the low noise, such a powered vessel is also suitable for observation of animals and/or people. Due to the low drive power, operation is also possible without an additional driving license.

Such a drive is insensitive to objects sucked in, which are usually simply sucked or blown through, without getting tangled within the drive. Sucked fish usually pass through the waterjet propulsion unit unharmed. This allows the operation in environments with endangered fish stocks. In connection with the preferred drive by means of a low-noise electric motor, many creatures are neither disturbed nor killed.

In summary, it can be stated that the subject waterjet propulsion system only requires low drive power and is insensitive to objects sucked in, and can thus be operated in environments or scenarios in which conventional drives either fail or are prohibited.

The subclaims relate to further advantageous embodiments of the invention.

It is hereby expressly referred to the wording of the claims, whereby the claims at this point are incorporated by reference into the description and are considered to be reproduced verbatim.

BRIEF DESCRIPTION OF THE DRAWING

The invention will be described in more detail with reference to the accompanying drawings, in which only a preferred embodiment is shown by way of example, wherein.

DETAILED DESCRIPTION OF PREFERRED EMBODIMENTS

Figure 1:
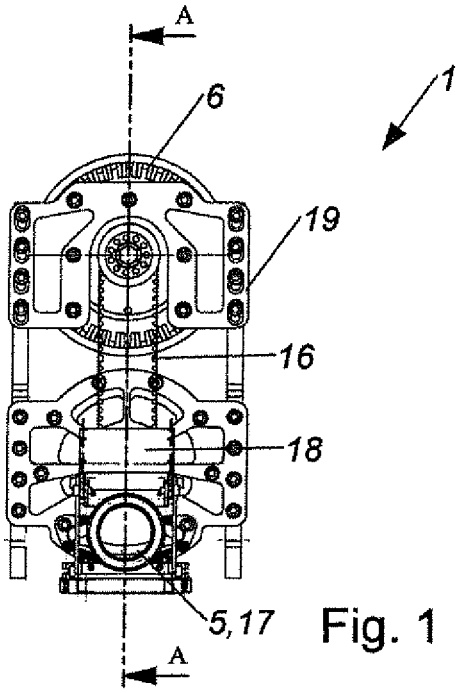
FIG. 1 shows a first embodiment of a subject waterjet propulsion system in elevation.

FIGS. 1 to 6 show different views of a preferred embodiment of a waterjet propulsion system 1 for a watercraft, having an intake region 2, an impeller region 3 adjoining the intake region 2, in which a single-stage impeller 4 is arranged, and one outlet nozzle 5 adjoining the impeller region 3, wherein the waterjet propulsion system 1 has a drive motor 6 which is at least indirectly connected to an impeller drive shaft 7 of the impeller 4, wherein the impeller 4 has only a single blade 8.

The subject waterjet propulsion system 1 has a simple and above all compact design. The waterjet propulsion system 1 has a hydrodynamically clean structure, whereby the required drive power is low.

As a result, a waterjet propulsion system 1 can be created which only requires a low drive power. Because of the low drive power required, emission-free operation is also possible with an electric motor and batteries, wherein the waterjet propulsion system 1 is still able to supply enough thrust to operate a watercraft in an agile manner. By operation with an electric motor, and thus further associated low noise, such a powered watercraft can be operated virtually without restrictions on all waters, including environmental protection areas. Due to the low noise, such a powered vessel is also suitable for observation of animals and/or people. Due to the low drive power, operation is also possible without an additional driving license.

Such a drive is insensitive to objects sucked in, which are usually simply sucked or blown through, without getting tangled within the drive. Sucked fish usually pass through the waterjet propulsion unit unharmed.

In summary, it can be stated that the subject waterjet propulsion system only requires low drive power and is insensitive to objects sucked in, and can thus be operated in environments or scenarios in which conventional drives either fail or are prohibited.

The drive in question concerns a waterjet propulsion system 1, therefore a drive in which water is sucked in, accelerated and discharged at an outlet nozzle 5. The waterjet propulsion system 1 is provided for the drive of a watercraft, wherein the watercraft is preferably a so-called jet boat, wherein other floating bodies may also be provided. Such jet boats are designated as personal watercraft or PWC in the small variants in which the driver sits on a saddle similar to a motorcycle or a snowmobile or simply stands on it, and controls the boat with a motorcycle-like handlebar.

Figure 2:
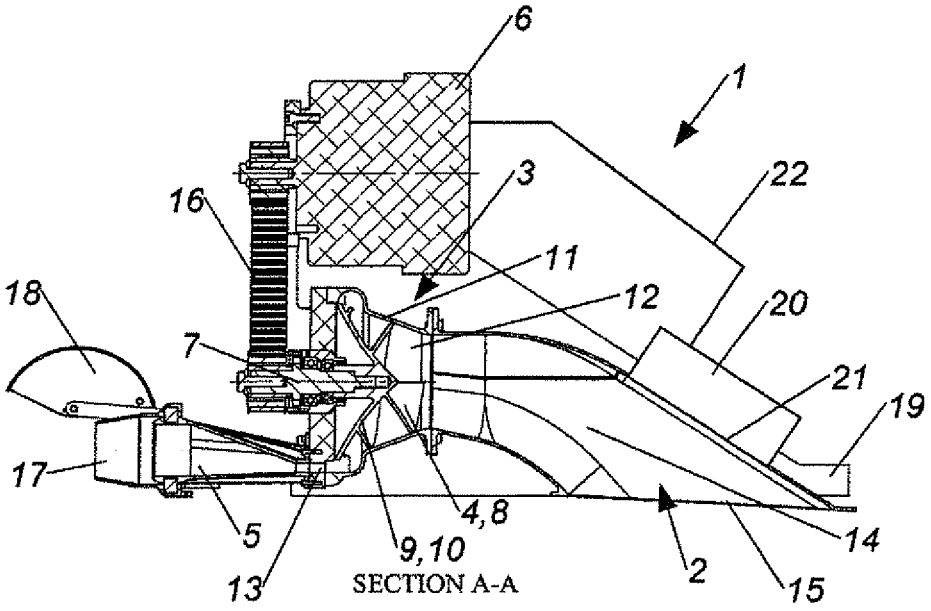
FIG. 2 shows the waterjet propulsion system according to FIG. 1 in a section A-A according to FIG. 1.
Figure 5:
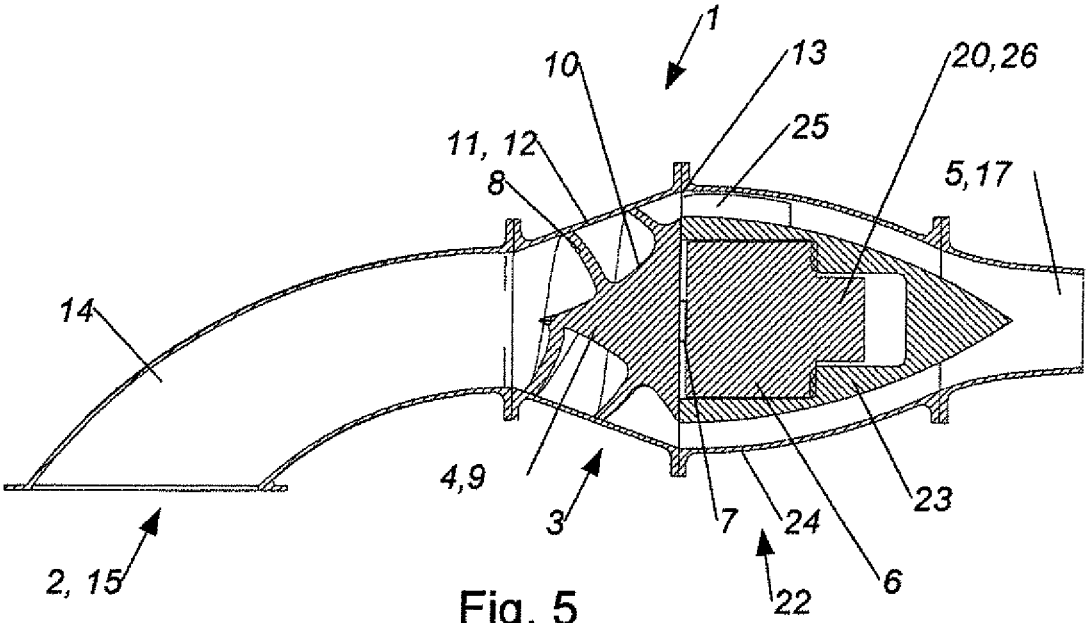
FIG. 5 shows a second embodiment of a subject waterjet propulsion system in elevation in a sectional view.

The water-jet drive 1 has an intake region 2, which preferably consists of an intake opening 15 and an intake channel 14 adjoining the intake opening 15. The intake region 2 is shaped such that, with an arrangement of the waterjet propulsion system 1 in a hull, an intake of water is possible, and the intake opening 15 is therefore below a waterline. As can be seen in FIGS. 2 and 5, the intake channel 14 has a cross-section which reduces in the flow direction, as a result of which a congestion effect can be achieved with a moving waterjet propulsion system 1.

The intake region 2 does not require a protective grid in the subject waterjet propulsion system 1, or only a very coarse-mesh guard which causes virtually no pressure losses. The intake region 2 can be constructed in terms of its desired hydrodynamic properties, wherein in the preferred embodiments no impeller drive shaft 7 is passed through the intake region 2, and consequently no sealed shaft bushing is required. In addition, the flow conditions in the intake region 2 are not adversely affected by an impeller drive shaft 7.

Preferably, although not shown in the figures, it is provided that the intake region 2 is designed to achieve a substantially homogeneous flow at the impeller region 3. In this regard, it is particularly provided that the intake region 2 is formed to be adjustable. Preferably, the angle of the intake opening 15 relative to the axis of rotation of the impeller 4 is adjustable in order to adjust the incident flow of the impeller region 3 to different speeds. It can also be provided to adjust the opening cross-section and/or the shape of the intake opening 15 in a predeterminable manner. By these measures, the efficiency of the waterjet propulsion system 1 can be increased.

An impeller region 3 adjoins the intake region 2, which can also be referred to as a pump region. In the impeller region 3, a single-stage impeller 4 is arranged. The impeller 4 is connected to an impeller drive shaft 7 which is connected to a drive motor 6 of the waterjet propulsion system 1.

The drive motor 6 is preferably designed as an electric motor. As a result of the high hydrodynamic quality of the intake region as well as the outlet nozzle 5 which is possible in the subject waterjet propulsion system 1, the necessary drive power can be kept very low. It has been recognized in this case that even a drive power of up to 11 kW is sufficient to operate such a powered watercraft in an agile manner. With such low drive power, operation is possible without a navigation license for recreational watercraft. In a drive by means of an electric motor, the required battery capacity is relevant in addition to the power of the electric motor itself. Of course, a drive of the subject waterjet propulsion system 1 with more powerful drives is possible.

In the preferred embodiment of the drive motor 6 as an electric motor, it is further preferably provided that the waterjet propulsion system 1 has a motor control unit 20 which is connected by means of circuitry to the electric motor or to its speed or power control unit, e.g. by means of the connecting line 22. In this case, the motor control unit 20 can be designed differently. According to a particularly preferred embodiment, the motor control unit 20 has at least one so-called inverter.

According to FIGS. 1 to 4, the motor control unit 20 has preferably a separate or independent housing, wherein at least one of the housing sides is formed as a cooling surface 21 or heat sink of the motor control unit 20. Power electronic components cause power loss in the form of heat. It is preferably provided that the at least one cooling surface 21 of the motor control unit 20 is arranged at least partially adjacent to the intake region 2. Thereby, the power loss of the motor control unit 20 can be dissipated quickly and safely.

According to a preferred embodiment, it is provided that the cooling surface 21 rests against a surface of the intake pipe 14, wherein the cooling surface 21 is formed separately from the surface of the intake pipe 14. This has the advantage that no sealing point must be provided in the intake region.

It can further preferably be provided for further improved heat dissipation to form the cooling surface 21 as part of the intake pipe 14. It is provided in this case that the motor control unit 20 is flanged into the intake pipe 14, and consequently, when removing the motor control unit 20, a corresponding opening in the intake pipe remains free.

Figure 6:
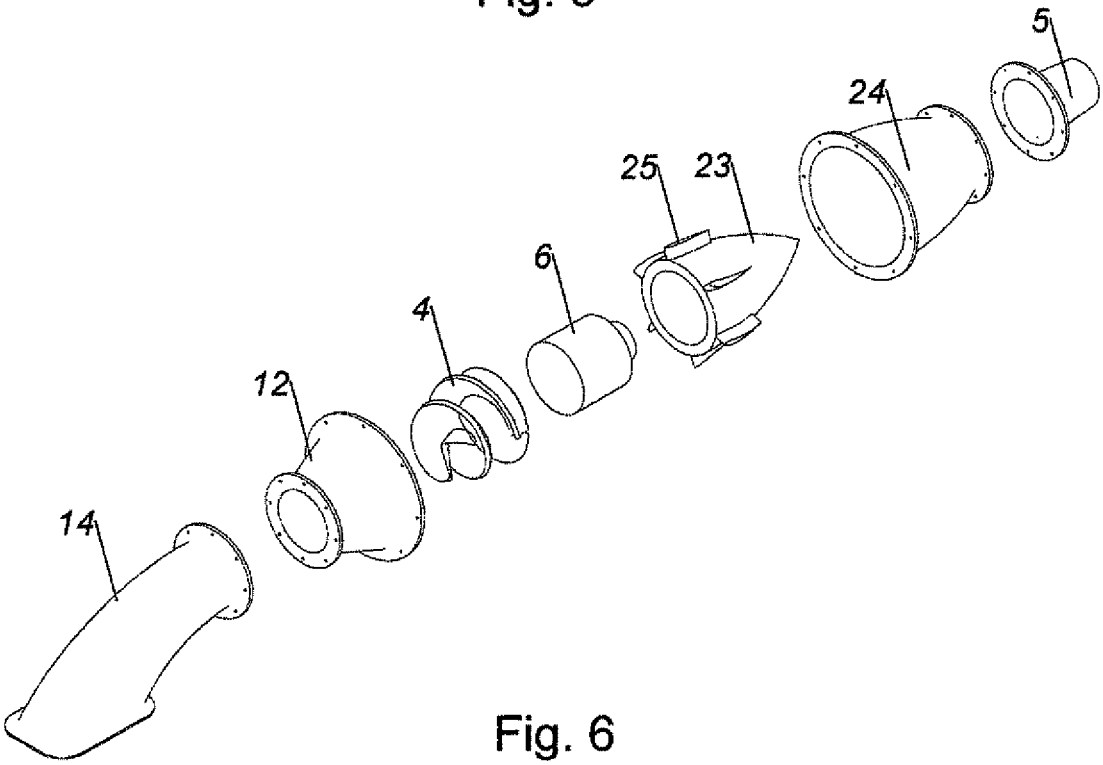
FIG. 6 shows the waterjet propulsion system of FIG. 5 in a first axonometric exploded view.

According to FIGS. 5 and 6, it is provided to arrange the motor control unit 20 directly on the drive motor 6. This will be described in detail when describing these embodiments.

The impeller region 3 is preferably designed as a combined axial/radial pump. There is both an acceleration of the water in the axial direction, as well as in the radial direction, as a result of which a high pressure ratio can be achieved with compact dimensions.

It is provided that the impeller 4 has only one single blade 8. It has been shown that consequently high efficiency can be achieved, but above all a very high insensitivity of the waterjet propulsion system against objects which are sucked in. These do not lead to a clogging or blockage of the impeller region 3 in the subject impeller 4, but are simply conveyed through the same. It has been shown, for example, that fish as a rule survive a passage through the subject waterjet propulsion system in an unscathed manner.

The one blade 8 is preferably arranged or formed as a substantially conical spiral around a blade base body 9. This allows an efficient liquid transport to be achieved, wherein no dangerous negative pressure regions appear which would lead to cavitation. The blade 8 therefore has the shape of a spiral line or helix, which, however, does not have a constant diameter, but which steadily widens in the manner of a mathematical spiral. It is preferably provided that the individual blade 8 is guided more than once around the blade base body 9.

It is particularly preferably provided that an inner end region of the blade 8, which is shown in a sectional view in FIG. 2, is arranged eccentrically, therefore not disposed on the axis of rotation of the impeller 4. Thereby, the clogging of the waterjet propulsion system 1 can be further reduced in that objects sucked in are effectively passed into the conveying space of the impeller 4 formed by the interstices of the blade 8.

It has been recognized that the efficiency of the impeller is particularly high when the blade 8 is predeterminably curved in the direction of the intake region 2, as shown for example in FIGS. 5 and 6. The blade 8 is bent in this case from the blade base body 9 both in the direction of the intake region 2 and the impeller housing 12.

The efficiency can be further improved by the blade 8 tapering away from the main blade body 9, i.e. in the direction of the impeller housing 12. In this case, it has been found to be advantageous in practice if the blade 8 next to the impeller housing 12 merely has a strength or thickness of about one millimeter. As a result, the hydrodynamic friction between the blade 8 and the impeller housing 12 can be reduced.

The blade base body 9 is preferably designed as a substantially rotationally symmetrical base body with a concave jacket surface 10. In the subject formation of the impeller 4 with only one single blade 8, the concave jacket surface 10, as can be seen approximately in FIG. 2, has proven to be superior over the shape of a drop.

The impeller 4 is arranged in an impeller housing 12. On an intake side of the impeller region 3 or the impeller housing 12, the intake pipe 14 is flanged to the impeller housing 12. An outlet nozzle 5 or outlet flow body housing 24 of an outlet region 22 is flanged onto a pressure side of the, in particular multi-part, impeller housing 12. Preferably, the impeller housing 12 is formed as a metal diecast part.

According to the preferred embodiment according to FIGS. 1 to 6, it is provided that an impeller housing inner wall 11 of an impeller housing 12 is formed in a frustoconical manner in the region of the impeller 4. As a result, both a simple production of the impeller housing 12 is supported, as well as simply a high degree of tightness between the impeller 4 and impeller housing inner wall 11 is achieved in that both parts each have a simple reworkable shape, thus making an adjustment of the two parts easily possible.

With regard to the further improvement of the efficiency, it has further been shown to be advantageous if the impeller housing inner wall 11 of an impeller housing 12 is curved in the region of the impeller 4 and, in particular, is substantially free of breakaway edges. As a result, a so-called non-developable shape is formed. Such an inner wall of the impeller housing 11 preferably has the shape of an edge-free and continuous curve with a turning point in cross-section. Such an impeller housing inner wall 11 is not shown in the figures.

It is preferably provided that the blade 8 extends as far as possible to the impeller housing inner wall 11. Due to small gaps in this area, the hydrostatic losses can be kept low.

The impeller 4 itself is arranged on an impeller drive shaft 7, which is mounted in a rear wall of the impeller housing 12. The impeller drive shaft 7 is directly or indirectly connected to the drive motor 6.

Hereinafter features of the two different preferred embodiments are described.

According to FIGS. 1 to 4, provision is preferably made for the drive motor 6 to be arranged in the installed position above the impeller region 3 and above the outlet nozzle 5. It is preferably provided that the impeller drive shaft 7 is arranged between the outlet nozzle 5 and the drive motor 6. As a result, a very compact waterjet propulsion system 1 is possible, especially one with a very short construction.

Figure 3:
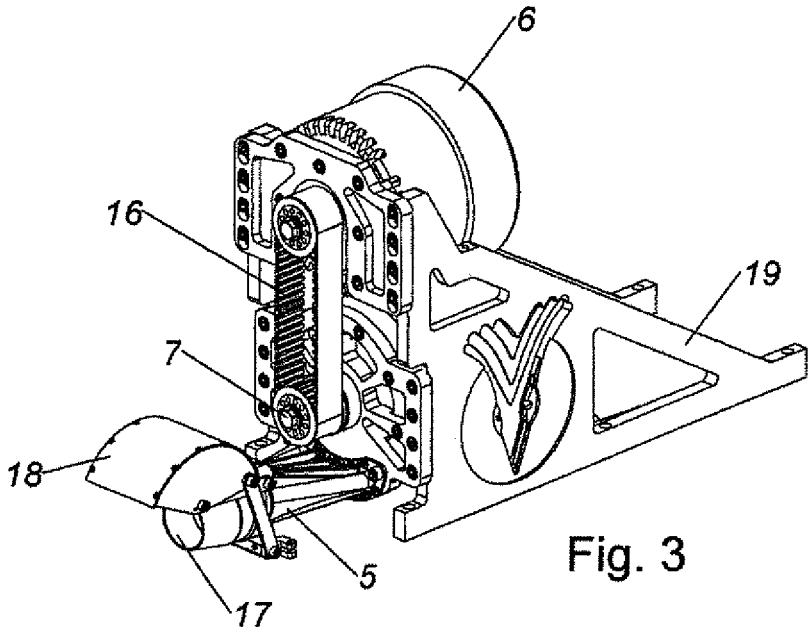
FIG. 3 shows the waterjet propulsion system according to FIG. 1 in a first axonometric view.
Figure 4:
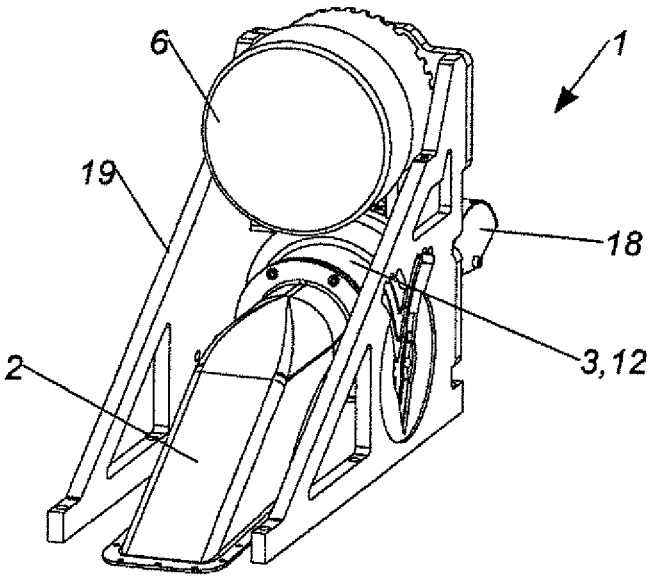
FIG. 4 shows the waterjet propulsion system according to FIG. 1 in a second axonometric view.

Preferably, the drive motor 6 is connected by means of a toothed belt 16, as shown in FIGS. 1 to 3, to the impeller drive shaft 7. As a result, an interlocking drive can simply be created, which has a certain amount of elasticity. Alternatively, a connection can be provided by means of chain drive, V-belt, friction wheels, gears or king shaft.

As already explained above, the impeller region 3 is connected to the outlet nozzle 5. In this case, it is provided in particular that the impeller region 3 is connected to the outlet nozzle 5 at only one outlet peripheral region 13. This outlet peripheral region 13 is preferably arranged on one side of the impeller region 3 or of the impeller housing 12, which—relative to the impeller drive shaft 7—lies opposite the drive motor 6. Due to the restriction to only one connection of the impeller region 3 with the outlet nozzle 5, and the preferred way of positioning this connection, the compact construction of the subject waterjet propulsion system 1 is further supported.

A flap 18 for thrust vector control or thrust reversal is arranged in a conventional manner at an outlet region 17 of the outlet nozzle 5, which is clearly visible for example in FIG. 3.

The particularly preferred embodiment according to FIGS. 1 to 4 further comprises a base frame 19, which is formed from light metal parts screwed together, and to which the individual components of the waterjet propulsion system 1 are attached.

FIGS. 5 and 6 show a particularly preferred second embodiment of a waterjet propulsion system 1.

Embodiments regarding the intake region 2 and impeller region 3 have already been explained above.

In the embodiment according to FIGS. 5 and 6, it is provided that the impeller region 3 is connected to the outlet nozzle 5 substantially over the entire circumference, wherein a so-called outlet region 22 is arranged between the impeller region 3 and the outlet nozzle 5.

In the outlet region 22, a conical outlet flow body 23 is arranged adjacent to the impeller region 3. This preferably has the same diameter as the impeller 4, to which it adjoins in order to achieve a substantially seamless or edgeless transition.

The conical outlet flow body 23 has a rotationally symmetrical and convex shape. Such a form is hydrodynamically favorable. Preferably, a jacket surface of a surrounding outlet flow body housing 24 has a correspondingly diametrically opposed shape. It is preferably provided that the distance between the outlet flow body 23 and the outlet flow body housing 24 is substantially constant. Due to the reduction in diameter in the direction of the subsequent outlet nozzle 5, there is a reduction in cross-section, which is continued by the outlet nozzle 5. As a result of this predetermined reduction in cross-section, the tendency towards cavities can be reduced in the impeller 3 by forming a pressure build-up against the flow direction, which can prevent that the pressure drops too much within the impeller region 3 and therefore cavitation occurs. As a result of this measure of diameter reduction and the associated increase in pressure on the impeller 4, the impeller 4 can further be operated at high speeds. Typical operating speeds of the subject impeller are 2000 $min^{-1}$ to 8000 $min^{-1}$, in particular in the range of 5000 $min^{-1}$, without causing cavitation. Due to the high rotational speeds, the impeller 4 may have a small diameter.

Furthermore, it has proved to be favorable in terms of flow that a predeterminable plurality of stators 25, in particular evenly distributed around the circumference, are arranged on the outlet flow body 23 adjacent to the impeller region 3. These stators 25 have, as shown in FIG. 6, a profile, and direct the flow to the outlet nozzle 5. Preferably, the outlet flow body 23 is connected to the outlet flow body housing 24 by means of the stators and is held in such a way.

It has been shown that a better adaptation of the waterjet propulsion system 1 to different driving conditions can be achieved in that the stators 25 are arranged and configured in an adjustable manner. These are then controlled in particular by a control and/or cruise control unit of the waterjet propulsion system 1 and a watercraft 1, wherein a drive from the drive motor 6 may be provided. The angle of attack of the stators 25 can be adjusted as a result of this adjustability.

Preferably, it is further provided that the drive motor 6 is arranged in the outlet flow body 23. The power supply is thereby provided by the stators 25. This allows a very direct and rigid drive of the impeller 4. Furthermore, this allows a good cooling of the drive motor 6. It is further preferably provided that the motor control unit 20 is arranged in the outlet flow body 23.

It is particularly preferred that between the drive motor 6 and the impeller drive shaft 7 of the impeller 4, a transmission, in particular a planetary gear, is arranged. It can also be provided in this case that the drive motor 6 itself already has a transmission. Preferably, the transmission is a mechanical transmission. The transmission is provided or formed for reducing or decreasing a drive motor speed or a lower impeller drive shaft speed. As a result, a high-speed drive motor 6 can be used, whereby a higher power can be achieved. As a result, an electric motor with a rotational speed between 12000 $min^{-1}$ and 25000 $min^{-1}$, in particular between about 16000 $min^{-1}$ and 18000 $min^{-1}$, can be used, whereby a very compact and at the same time powerful drive unit can be formed which can be integrated well into the outlet flow body 23. It is then of course preferably provided that both the drive motor 6 and the transmission are arranged in the outlet flow body 23.

With regard to the further improvement of the efficiency, it has proven to be advantageous that the drive motor 6 is connected to a measuring device 26 which is designed to detect the absolute and/or relative position of predeterminable rotatable parts of the drive motor 6 relative to predeterminable fixed parts thereof, and that the measuring device is connected to the motor control unit 20. Furthermore, the measuring device 26 has a temperature sensor to monitor the operating temperature of the drive motor 6. By knowing the absolute and/or relative position of the motor stator to the motor rotor, this can be taken into account in the control of the drive motor 6 by means of an inverter, and the efficiency of the drive can be further increased.

The invention claimed is:

1. A waterjet propulsion drive for a watercraft, comprising:

an intake region;

an impeller region adjoining the intake region;

a single-stage impeller arranged in the impeller region and including an impeller drive shaft, said impeller including only one single blade;

an outlet nozzle at least indirectly adjoining the impeller region; and a drive motor connected at least indirectly to the impeller drive shaft of the impeller, said drive motor embodied as an electric motor, wherein both the intake region and the outlet nozzle are formed in a drive-shaft-free manner, wherein the blade has a base body and is configured as a substantially conical spiral arranged about the blade base body, wherein the blade is guided more than once around the blade base body.

2. The waterjet propulsion drive of claim 1, wherein the impeller region is configured as a combined axial/radial pump.

3. The waterjet propulsion drive of claim 1, wherein the blade has a base body and is configured as a substantially conical spiral arranged about the blade base body.

4. The waterjet propulsion drive of claim 1, wherein the blade is predeterminably curved in a direction of the intake region.

5. The waterjet propulsion drive of claim 3, wherein the blade tapers away from the base body.

6. A waterjet propulsion drive for a watercraft, comprising:

an intake region;

an impeller region adjoining the intake region;

a single-stage impeller arranged in the impeller region and including an impeller drive shaft, said impeller including only one single blade;

an outlet nozzle at least indirectly adjoining the impeller region; and a drive motor connected at least indirectly to the impeller drive shaft of the impeller, said drive motor embodied as an electric motor, wherein both the intake region and the outlet nozzle are formed in a drive-shaft-free manner, wherein the blade has a base body and is configured as a substantially conical spiral arranged about the blade base body, wherein the blade base body is configured as a substantially rotationally symmetrical base body with a concave jacket surface.

7. The waterjet propulsion drive of claim 1, wherein the impeller includes an impeller housing having an impeller housing inner wall which is formed in a frustoconical manner in a region of the impeller.

8. The waterjet propulsion drive of claim 1, wherein the impeller includes an impeller housing having an impeller housing inner wall which is formed in a curved manner in a region of the impeller.

9. A waterjet propulsion drive of for a watercraft, comprising:

an intake region;

an impeller region adjoining the intake region;

a single-stage impeller arranged in the impeller region and including an impeller drive shaft, said impeller including only one single blade;

an outlet nozzle at least indirectly adjoining the impeller region; and a drive motor connected at least indirectly to the impeller drive shaft of the impeller, said drive motor embodied as an electric motor, wherein both the intake region and the outlet nozzle are formed in a drive-shaft-free manner, wherein the impeller region is connected to the outlet nozzle at only one outlet peripheral region.

10. The waterjet propulsion drive of claim 1, wherein the impeller region is connected to the outlet nozzle substantially over an entire circumference, and further comprising an outlet region arranged between the impeller region and the outlet nozzle.

11. The waterjet propulsion drive of claim 10, further comprising a conical outlet flow body arranged in the outlet region in adjoining relation to the impeller region.

12. The waterjet propulsion drive of claim 11, wherein the conical outlet flow body has a rotationally symmetrical and convex shape.

13. A waterjet propulsion drive for a watercraft, comprising:

an intake region;

an impeller region adjoining the intake region;

a single-stage impeller arranged in the impeller region and including an impeller drive shaft, said impeller including only one single blade;

an outlet nozzle at least indirectly adjoining the impeller region, with both the intake region and the outlet nozzle being formed in a drive-shaft-free manner;

a drive motor connected at least indirectly to the impeller drive shaft of the impeller, said drive motor embodied as an electric motor; and a predeterminable plurality of stators arranged adjacent to the impeller region, said stators being arranged around a circumference on the outlet flow body.

14. The waterjet propulsion drive of claim 13, wherein the stators are arranged in a predeterminably adjustable manner.

15. The waterjet propulsion drive of claim 1, further comprising a transmission arranged between the drive motor and the impeller drive shaft of the impeller.

16. The waterjet propulsion drive of claim 1, wherein the drive motor is arranged, when installed, above the impeller region and above the outlet nozzle.

17. The waterjet propulsion drive of claim 11, wherein the drive motor is arranged in the outlet flow body.

18. A waterjet propulsion drive for a watercraft, comprising:

an intake region;

an impeller region adjoining the intake region;

a single-stage impeller arranged in the impeller region and including an impeller drive shaft, said impeller including only one single blade;

an outlet nozzle at least indirectly adjoining the impeller region, with both the intake region and the outlet nozzle being formed in a drive-shaft-free manner;

a drive motor connected at least indirectly to the impeller drive shaft of the impeller, said drive motor embodied as an electric motor, wherein both the intake region and the outlet nozzle are formed in a drive-shaft-free manner; and a motor control unit connected to the electric motor and including at least one cooling surface which is arranged at least in sections adjacent to the intake region.

19. A waterjet propulsion drive for a watercraft, comprising:

an intake region;

an impeller region adjoining the intake region;

a single-stage impeller arranged in the impeller region and including an impeller drive shaft, said impeller including only one single blade;

an outlet nozzle at least indirectly adjoining the impeller region, with both the intake region and the outlet nozzle being formed in a drive-shaft-free manner;

a drive motor connected at least indirectly to the impeller drive shaft of the impeller, said drive motor embodied as an electric motor, wherein both the intake region and the outlet nozzle are formed in a drive-shaft-free manner;

a motor control unit connected to the electric motor; and a conical outlet flow body arranged in the outlet region in adjoining relation to the impeller region, said motor control unit being arranged in the outlet flow body.

20. A waterjet propulsion drive for a watercraft, comprising:

an intake region;

an impeller region adjoining the intake region;

a single-stage impeller arranged in the impeller region and including an impeller drive shaft, said impeller including only one single blade;

an outlet nozzle at least indirectly adjoining the impeller region, with both the intake region and the outlet nozzle being formed in a drive-shaft-free manner;

a drive motor connected at least indirectly to the impeller drive shaft of the impeller, said drive motor embodied as an electric motor, wherein both the intake region and the outlet nozzle are formed in a drive-shaft-free manner;

a motor control unit connected to the electric motor; and a measuring device connected to the drive motor and configured to detect an absolute and/or relative position of rotatable parts of the drive motor relative to fixed parts of the drive motor, said measuring device being connected to the motor control unit.

21. A waterjet propulsion drive for a watercraft, comprising:

an intake region;

an impeller region adjoining the intake region;

a single-stage impeller arranged in the impeller region and including an impeller drive shaft, said impeller including only one single blade;

an outlet nozzle at least indirectly adjoining the impeller region; and a drive motor connected at least indirectly to the impeller drive shaft of the impeller, said drive motor embodied as an electric motor, wherein both the intake region and the outlet nozzle are formed in a drive-shaft-free manner, wherein the intake region is adjustably designed for achieving a substantially homogeneous flow at the impeller region.

22. A watercraft, comprising a waterjet propulsion drive, said waterjet propulsion drive comprising an intake region, an impeller region adjoining the intake region, a single-stage impeller arranged in the impeller region and including an impeller drive shaft, said impeller including only one single blade, an outlet nozzle at least indirectly adjoining the impeller region, and a drive motor connected at least indirectly to the impeller drive shaft of the impeller, said drive motor embodied as an electric motor, wherein both the intake region and the outlet nozzle are formed in a drive-shaft-free manner, wherein the blade has a base body and is configured as a substantially conical spiral arranged about the blade base body, wherein the blade is guided more than once around the blade base body.

23. The waterjet propulsion drive of claim 13, wherein the stators are evenly distributed around the circumference on the outlet flow body.

* * * * *